US008320602B2

(12) United States Patent
Liu et al.

(10) Patent No.: US 8,320,602 B2
(45) Date of Patent: Nov. 27, 2012

(54) ADJUSTABLE EARPHONE

(75) Inventors: Chun-Hsin Liu, Taipei County (TW); Shu-Yuan Cheng, Taipei (TW); Liang-Yi Liu, Taipei (TW)

(73) Assignees: Silitek Electronic (Guangzhou) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 1006 days.

(21) Appl. No.: 12/116,963

(22) Filed: May 8, 2008

(65) Prior Publication Data

US 2009/0097690 A1 Apr. 16, 2009

(30) Foreign Application Priority Data

Oct. 13, 2007 (CN) ..... 2007 1 0030858

(51) Int. Cl.
*H04R 25/00* (2006.01)

(52) U.S. Cl. ..... 381/381

(58) Field of Classification Search ..... 381/370–371, 381/374, 376, 379, 380–382, 384, 386
See application file for complete search history.

(56) References Cited

U.S. PATENT DOCUMENTS

| | | | | |
|---|---|---|---|---|
| 7,120,268 | B2 * | 10/2006 | Murozaki et al. | 381/381 |
| 2007/0104345 | A1 * | 5/2007 | Yang | 381/381 |
| 2008/0187165 | A1 * | 8/2008 | Kao et al. | 381/386 |

* cited by examiner

*Primary Examiner* — Hoa B Trinh
(74) *Attorney, Agent, or Firm* — Li & Cai Intellectual Property (USA) Office

(57) ABSTRACT

An earphone includes a body with a surrounding side, a rotatable loop and an ear hook. The rotatable loop is pivotally connected with the body on two opposite ends of the surrounding side. The body and the rotatable loop can rotate with respect to a first axis and with respect to each other. The ear hook is pivotally mounted on one side of the rotatable loop near where the rotatable loop is connected with the body, and the ear hook can rotate with respect to a second axis, which is different from the first axis.

10 Claims, 8 Drawing Sheets

ADJUSTABLE EARPHONE

BACKGROUND OF THE INVENTION

1. Field of the Invention

The present invention relates to an audio signal playback apparatus, and more particularly, to an earphone.

2. Description of the Prior Art

Multi-media devices, such as computers, mobile phones, or MP3 players, are commonly used devices that can provide a wide variety of multi-media entertainment. Earphones are often used in conjunction with these devices for convenience, particularly when the devices are portable.

Commercial headsets are available as mono headsets and stereo headsets. The former is usually applied in cell phones to provide hands-free capability. When the headsets are connected to Bluetooth modules, users can answer telephone calls through the headsets directly. In general, mono headsets are designed to be small and delicate. Mono headsets, however, are not suitable for listening to stereo music, not only because they comprise only one earphone but also because the sound is limited to the vocal frequency range (300 Hz~3 KHz).

Stereo headsets are mostly used when users wish to listen to music as they have two earphones for providing stereo sound. There are three types of stereo headsets: head-wear headsets, neck-wear headsets, and ear-wear headsets, and they generally comprise a right earphone and a left earphone, wherein the right earphone is unable to be worn on the left ear and vice versa.

Moreover, one earphone of the stereo headset may have the function of Bluetooth. This is very convenient, as a user does not need to disconnect the stereo headset to answer the phone. The Bluetooth earphone is generally designed for only one ear according to the structure of the ear, and comprises a body and an ear hook that is only suitable for that particular ear; however, wearing the earphone in the same ear for a long time is uncomfortable. In addition, there is a need to adjust the distance between the ear hook and the ear according to the user's preference. The conventional techniques available are unable to overcome the above-mentioned problems.

SUMMARY OF THE INVENTION

It is therefore one of the objectives of the present invention to provide an earphone in order to solve the above-mentioned problem. The earphone can be worn on the left or right ear depending on the requirements of the user, and the distance between the ear hook and the user's ears can also be adjusted. In addition, it can act as a stereo Bluetooth earphone to provide not only a means of listening to music through the cell phone but also provides hands-free capability.

According to an exemplary embodiment of the present invention, an earphone is provided. The earphone comprises a body having a surrounding side; a rotatable loop pivotally connected with the body on the two opposite ends of the surrounding side, wherein the body and the rotatable loop can rotate oppositely with respect to a first axis; and an ear hook, pivotally mounted on one side of the rotatable loop near where the rotatable loop is connected with the body, capable of rotating with respect to a second axis, which is on a plane that the rotatable loop is positioned on and is different from the first axis.

According to an exemplary embodiment of the present invention, a stereo earphone apparatus comprising the earphone mentioned above is also provided.

The earphone of the present invention can be worn on the left or right ear because the body can pivot on the first axis by 360 degrees within the surrounding side so as to avoid the discomfort due to long-term use. In addition, the ear hook on the one side of the surrounding side can pivot on the second axis perpendicular to the first axis so the distance between the ear hook and the ear can be adjusted to make the user more comfortable. Furthermore, when the earphone of the present invention has the function of Bluetooth and is applied to a stereo earphone apparatus, it provides not only a means of listening to music through the cell phone but also provides hands-free capability. In addition, if both earphones in a stereo headset utilize the earphone of the present invention, comfort and convenience are increased. This is because both the left and right earphones adopt the same structure and can be utilized on either ear.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
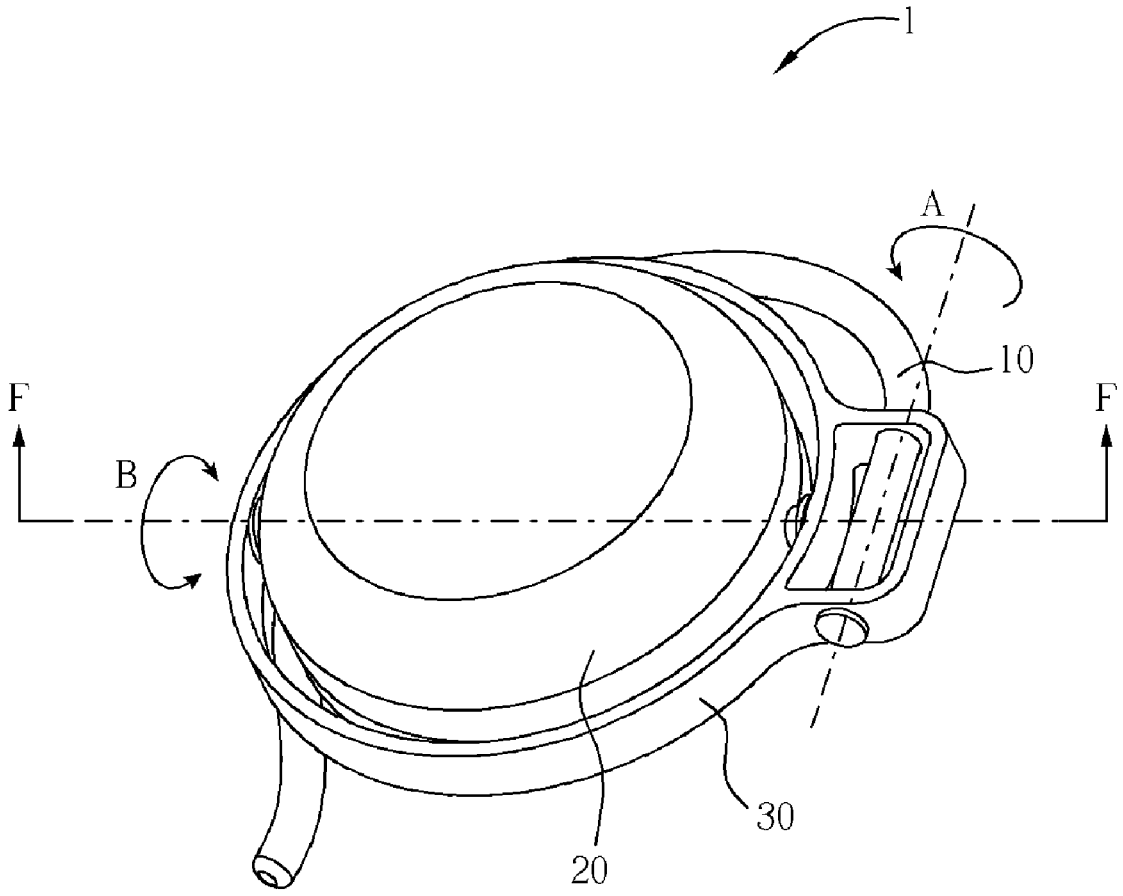
FIG. 1 is a diagram illustrating an earphone according to a first exemplary embodiment of the present invention.

Please refer to FIG. 1. FIG. 1 is a diagram illustrating an earphone 1 according to a first exemplary embodiment of the present invention. In this embodiment, the earphone 1 comprises a hook 10 for going around the ear, a body 20 and a rotatable loop 30. The rotatable loop 30 is a circular ring and surrounds the body 20. The body 20 and the rotatable loop 30 are capable of pivoting on an axis B through 360 degrees as shown by the arrow in FIG. 1. The ear hook 10 is fixed at a side of the rotatable loop 30, and is capable of pivoting on an axis A through 360 degrees as shown by the arrow in FIG. 1. The axis A is on the plane defined by the rotatable loop 30, and is preferably perpendicular to the axis B. To wear the earphone 1, the ear hook 10 has to be rotated out from the position shown in FIG. 1 about the axis A in the arrow direction by an appropriate degree. In this case, the earphone 1 is suitable for the right ear. To wear the earphone 1 on the left ear, the rotatable loop 30 should be rotated 180 degrees about the axis B. The simplicity of the rotatable loop 30 design enables the user to rotate it intuitively to selectively wear the earphone 1 on the left or right ear.

Figure 2:
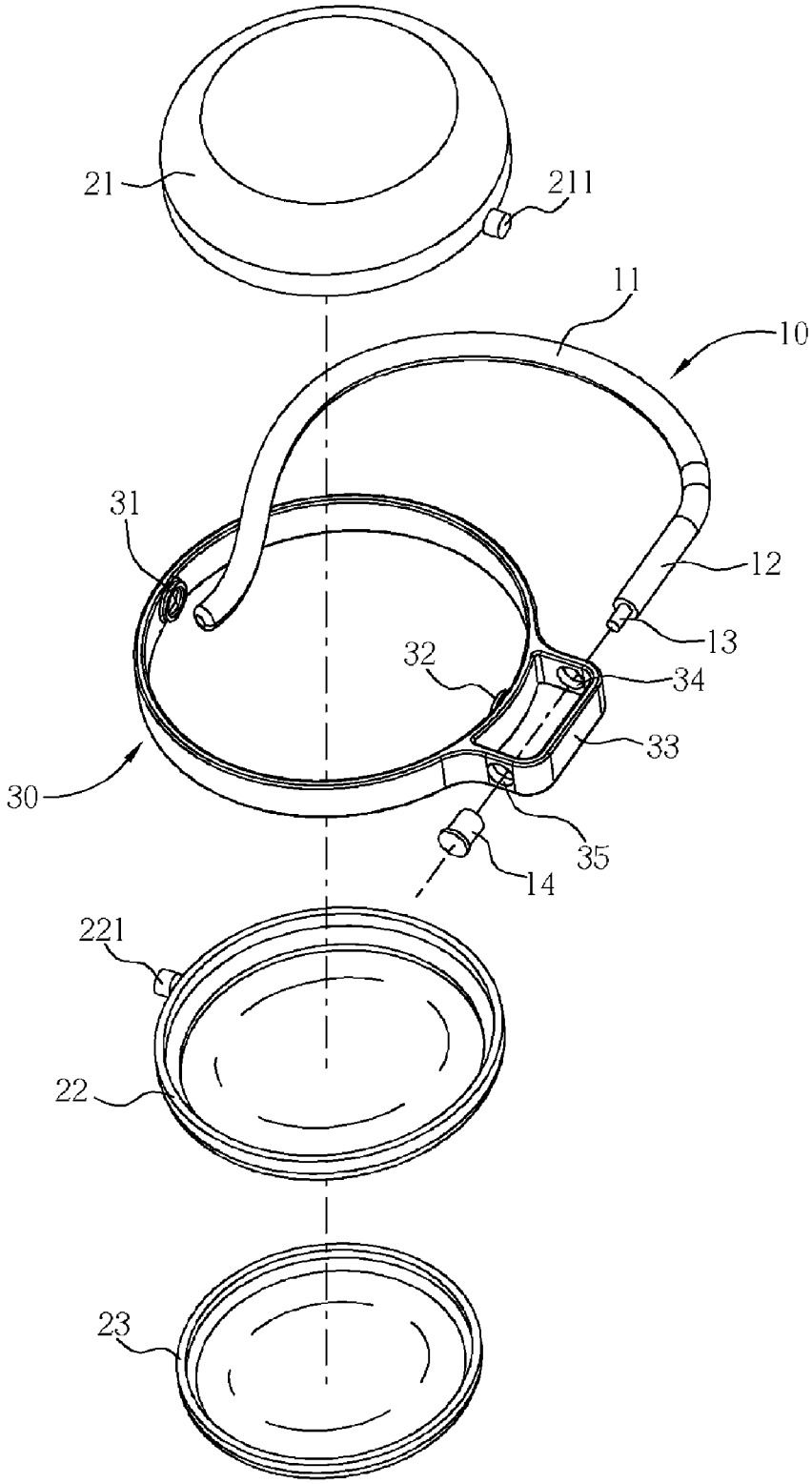
FIG. 2 is a schematic exploded diagram illustrating the earphone according to the first exemplary embodiment of the present invention.

Please refer to FIG. 2. FIG. 2 is a schematic exploded diagram illustrating the earphone 1 according to the first exemplary embodiment of the present invention. The body 20 comprises an upper housing 21 and a lower housing 22. The upper housing 21 and the lower housing 22 can be combined together. The body 20 further comprises a sponge pad 23 attached to the outer surface of the lower housing 22. The joining technique of the upper housing 21 and lower housing 22 to the rotatable loop utilizes mortise and tenon joints. A through tenon 211 extends from the edge of the upper housing 21; a through tenon 221 also extends from the edge of the lower housing 22 in the opposite direction to the through tenon 211. The sponge pad 23 is an optional element that provides extra comfort when wearing the earphone 1.

The rotatable loop 30 is a circular ring. A pair of pivot holes (mortises) 31, 32 are disposed at opposite sides of the rotatable loop 30. For assembly, the through tenon 211 of the upper housing 21 is inserted into the pivot hole 32, and the through tenon 221 of the lower housing 22 is inserted into the pivot hole 31. The whole body 20 formed by the upper housing 21 and the lower housing 22 can thereby pivot on a central axis of the through tenons 211, 221 through 360 degrees within the circular ring.

Figure 3:
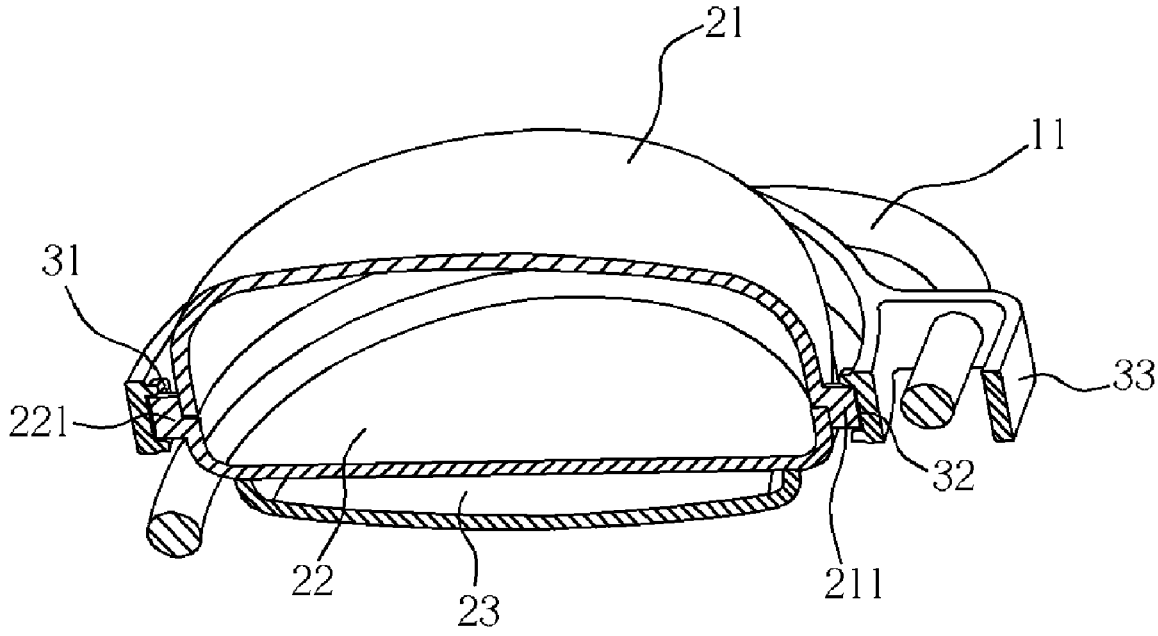
FIG. 3 is a cross-sectional diagram taken along line F-F shown in FIG. 1.

Please refer to FIG. 3. FIG. 3 is a cross-sectional diagram taken along the line F-F shown in FIG. 1. Preferably, the through tenons 211, 221 respectively extend from the edges of the upper housing 21 and the lower housing 22 to ensure that the upper housing 21 and the lower housing 22 are tightly attached to each other after the through tenons 211, 221 are respectively inserted into the pivot holes (mortises) 31, 32. Of course, if the upper housing 21 and the lower housing 22 tightly attached to each other forms an inner space and the central axes of the two through tenons are in the same straight line, any types of tenons are usable.

Please refer to FIG. 2 again. The rotatable loop 30 has an ear-hook pin-jointed part 33 formed outside of the rotatable loop 30 near the pivot hole 32. The ear-hook pin-jointed part 33 has a pair of spaced holes 34 and 35. An end of the ear hook 10 goes through the holes 34, 35 to fix the ear hook 10 in the ear-hook pin-jointed part 33.

Figure 4:
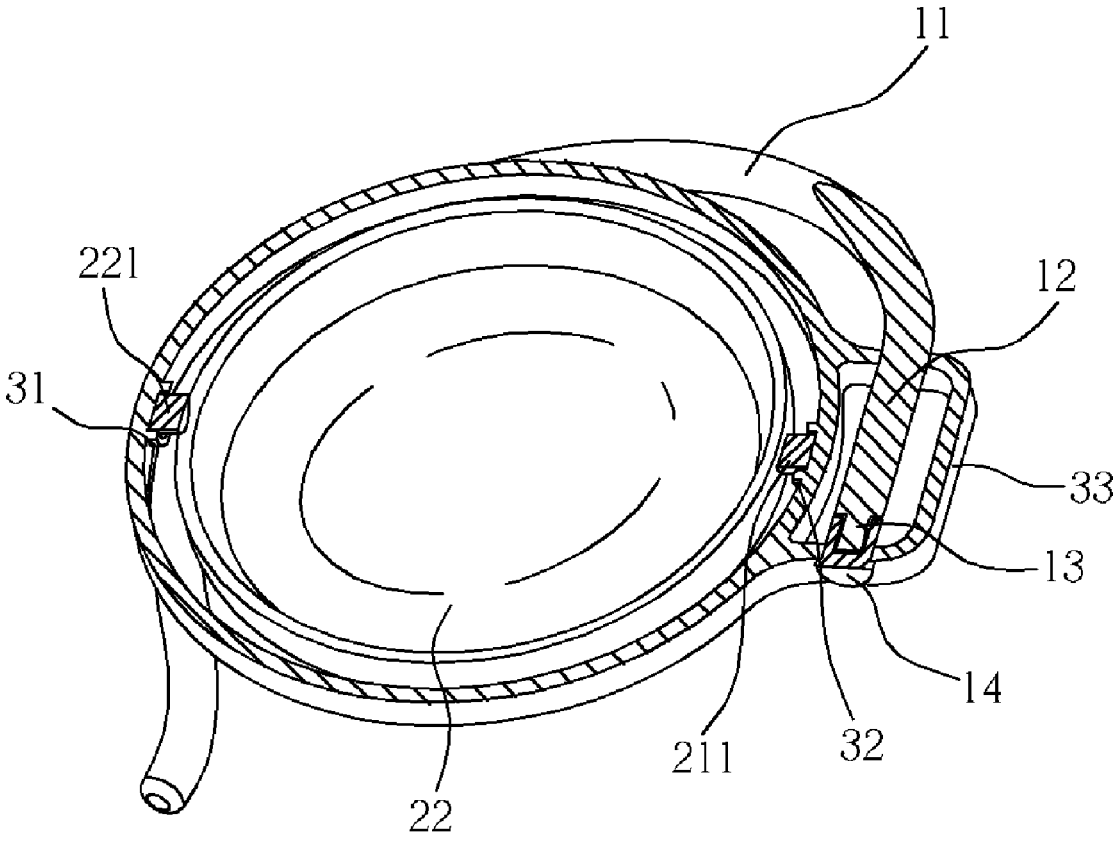
FIG. 4 is a transversely perspective cross-sectional diagram according to the first exemplary embodiment of the present invention.

Please refer to FIG. 4. FIG. 4 is a transversely perspective cross-sectional diagram according to the first exemplary embodiment of the present invention. The ear hook 10 comprises a hanging part 11, a pivot part 12, a fixed part 13 and a cap 14. Preferably, the pivot part 12 and the fixed part 13 are both cylindrical in shape. The diameter of the pivot part 12 is slightly smaller than the inner diameter of the holes 34, 35, and the diameter of the fixed part 13 is smaller than the diameter of the pivot part 12. The cap 14 consists of a cap body that matches the fixed part 13, and a cap top that covers the top of the fixed part 13. Preferably, the outer diameter of the cap body is not greater than the inner diameter of the holes 34, 35, and the outer diameter of the cap top is slightly greater than the inner diameter of the holes 34, 35, and the outer diameter of the cap body is equal to the diameter of the pivot part 12. For assembly, the cap 14 is positioned first. The end of the ear hook 10 with the fixed part 13 goes through the holes 34, 35 and is inserted into the ear-hook pin-jointed part 33. The cap 14 then sheathes the fixed part 13. Since the outer diameter of the cap top is slightly greater than the inner diameter of the holes 34, 35, the ear hook 10 is fixed in the ear-hook pin-jointed part 33. The ear hook 10 is then able to pivot on the central axis of the holes 34, 35.

Optionally, the rotatable loop 30 can be a half ring whose radian is not less than 180 degrees as long as a pair of pivot holes 31, 32 that are positioned opposite to each other can be disposed on the inside of the rotatable loop 30.

The rotatable loop 30 can also be other shapes of rings or half rings such as rhombus, triangle and diamond, etc., although the shape of the rotatable loop 30 preferably matches the contour of the earphone body 20.

Optionally, the ear-hook pin-jointed part 33 of the rotatable loop 30 is not limited to be in the shape of a rectangular handle as shown in FIG. 1. The ear-hook pin-jointed part 33 can be any shape as long as there is a pair of holes 34, 35 at opposite ends of the structure. For example, the ear-hook pin-jointed part 33 can be two protuberances separated from each other. A hole is formed on each protuberance, and the two holes are opposite to each other and have the same central axis. The ear-hook pin-jointed part 33 can also be a protuberance having a via-hole of predetermined length extended along the center of the protuberance. The ear hook 10 is inserted into the via-hole and is able to pivot on the central axis of the via-hole.

Figure 5:
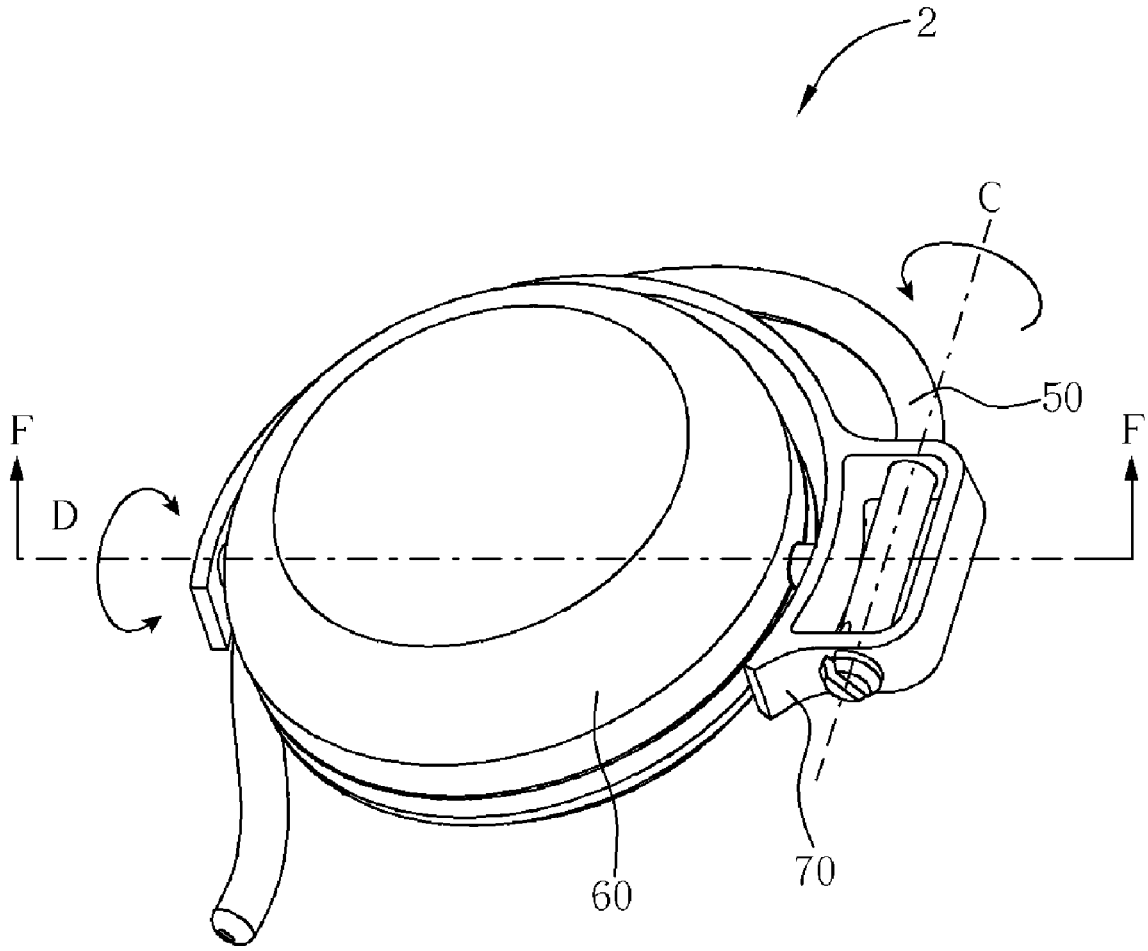
FIG. 5 is a diagram illustrating an earphone according to a second exemplary embodiment of the present invention.

Please refer to FIG. 5. FIG. 5 is a diagram illustrating an earphone 2 according to a second exemplary embodiment of the present invention. In this embodiment, the earphone 2 comprises an ear hook 50, a body 60 and a rotatable loop 70. The rotatable loop 70 is a half ring surrounding the body 60 and is pivotally connected with the body 60. The body 60 and the rotatable loop 70 are capable of pivoting on an axis D through 360 degrees as shown by the arrow in FIG. 5. The ear hook 50 is fixed at a side of the rotatable loop 70, and is capable of pivoting on an axis C through 360 degrees as shown by the arrow in FIG. 5. The axis C is on the plane defined by the rotatable loop 70, and is preferably perpendicular to the axis D. Since the wearing method of the earphone 2 is the same as the earphone 1, further description is not detailed here for the sake of brevity.

Figure 6:
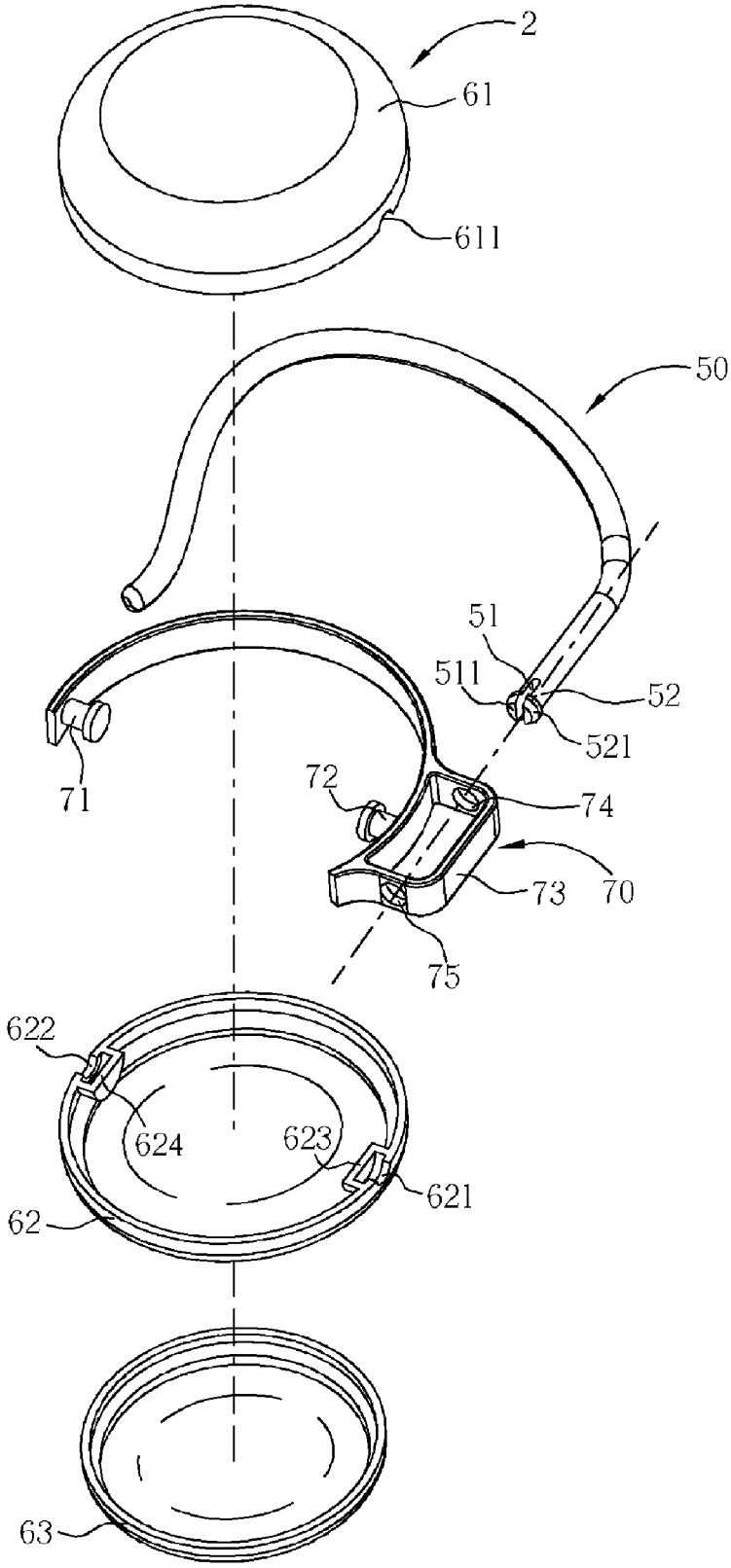
FIG. 6 is a schematic exploded diagram illustrating the earphone according to the second exemplary embodiment of the present invention.
Figure 7:
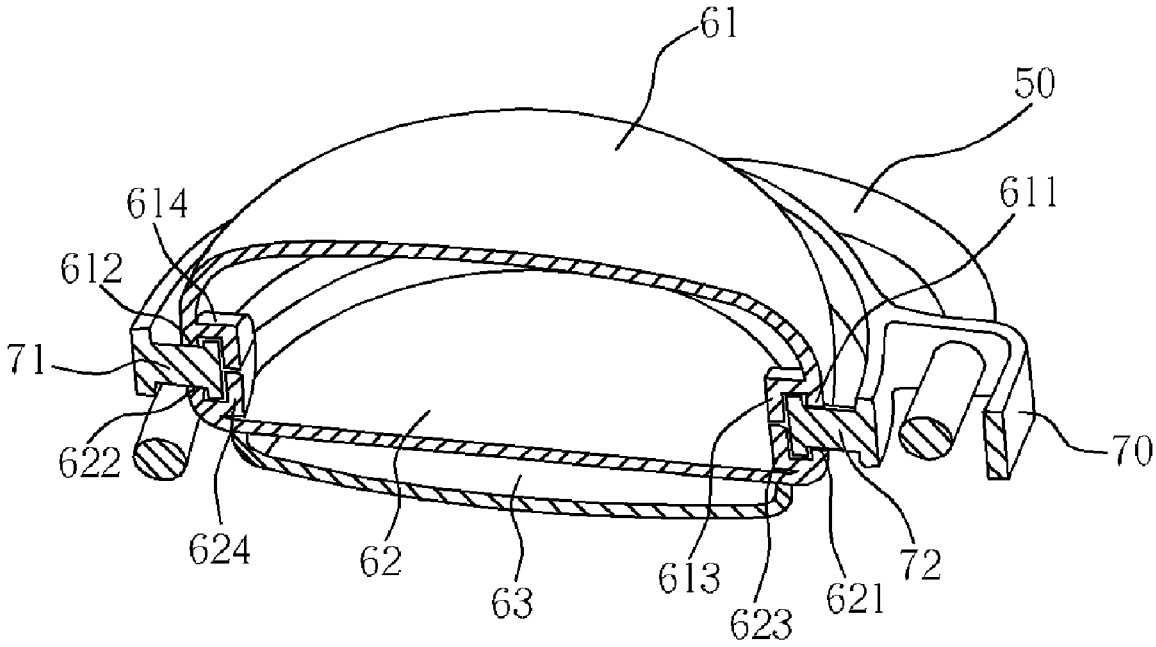
FIG. 7 is a cross-sectional diagram taken along line F-F shown in FIG. 4.

Please refer to FIG. 6 and FIG. 7. FIG. 6 is a schematic exploded diagram illustrating the earphone 2 according to the second exemplary embodiment of the present invention. FIG. 7 is a cross-sectional diagram taken along line F-F shown in FIG. 5. The body 60 comprises an upper housing 61, a lower housing 62 and a sponge pad 63. There are concave gaps 621, 622 respectively disposed inside the lower housing 62 in a radial direction. There are also concave gaps 611, 612 respectively disposed inside the upper housing 61 in a radial direction respectively corresponding to the concave gaps 621, 622. When the upper housing 61 is attached to the lower housing 62, the concave gap 611 of the upper housing 61 and the concave gap 621 of the lower housing 62 meet to form a hole of fixed size. Similarly, the concave gap 612 of the upper housing 61 and the concave gap 622 of the lower housing 62 meet to form a second hole of fixed size. Preferably, a pair of position-limited structures 623, 624 is disposed in the lower housing 62, and a pair of position-limited structures 613, 614 is disposed in the upper housing 61 respectively corresponding to the pair of structures 623, 624. When the upper housing 61 is attached to the lower housing 62, the position-limited structures 613, 623 meet to form a hollow space, which is connected with the space outside of the body 60 via the fixed hole formed by the concave gaps 611, 621. Similarly, the position-limited structures 614, 624 meet to form a hollow space, which is connected with the space outside of the body 60 via the fixed hole formed by the concave gaps 612, 622.

The rotatable loop 70 is a half ring. A pair of tenons 71, 72 extend from inner side the rotatable loop 70 along the diameter to the center of the half ring. The pair of tenons 71, 72 each consists of two parts. One part is a tenon part and the other part is a top part that extends from the tenon part. The diameter of the top part is greater than that of the tenon part. During assembly, the tenon 71 is assembled in the fixed hole formed by the concave gaps 612, 622, and the top part of the tenon 71 is contained in the hollow space formed by the structures 614, 624. Similarly, the tenon 72 is assembled in the fixed hole formed by the concave gaps 611, 621, and the top part of the tenon 72 is contained in the hollow space formed by the structures 613, 623. The structures are used to prevent the tenons from moving towards the inside of the body and thereby damaging the electronic elements in the body. In addition, the diameter of the tenon part is less than the diameter of the fix hole, and the diameter of the top part is greater than the diameter of the fix hole. This design enables the rotatable loop 70 and the body 60 to be pivotally connected to each other without separating, but still allows the body 60 to pivot on the central axis of the body 60 and the rotatable loop 70 (i.e. the D axis shown in FIG. 5). In fact, the rotatable loop 70 is also able to pivot on the central axis of the body 60 and the rotatable loop 70. Either rotating the body 60 by 180 degrees or rotating the rotatable loop 70 by 180 degrees can adjust the earphone 2 to the left or right ear. Rotating the rotatable loop is more intuitive; in other words, the rotatable loop helps the user instinctively adjust the earphone 2 to the left or right ear.

Please continue to refer to FIG. 6. Besides the tenons 71 and 72, the rotatable loop 70 further comprises an ear-hook pin-jointed part 33 formed outside of the rotatable loop 73 near the tenon 72. The ear-hook pin-jointed part 73 has a pair of holes 74, 75, which are positioned at opposite ends of the structure. An end of the ear hook 50 goes through the holes 74, 75 to fix the ear hook 10 in the ear-hook pin-jointed part 73.

The end of the ear hook 50 fixed in the ear-hook pin-jointed part 73 further comprises a pair of elastic arms 51, 52. The ends of the elastic arms 51, 52 are respectively clutch units 511, 521. The clutch units 511, 521 can be closed under a certain amount of pressure and are capable of going through the holes 74, 75. The elastic arms 51, 52 return to their original position when the pressure is not in effect and the ends of the elastic arms 51, 52 separate so that the clutch units 511, 521 clutch respectively edges of the holes 74, 75 to fix the ear hook 50 in the ear-hook pin-jointed part 73. The ear hook 50 is capable of pivoting on the central axis of the holes 74, 75.

Figure 8:
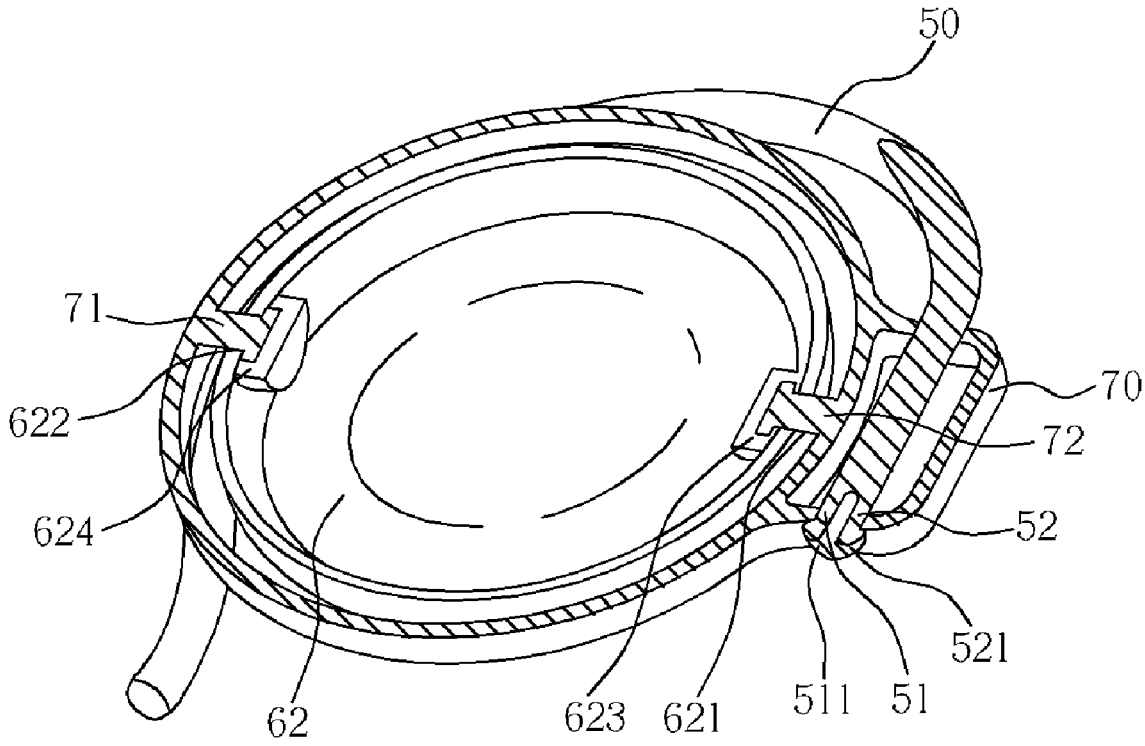
FIG. 8 is a transversely perspective cross-sectional diagram according to the second exemplary embodiment of the present invention.

Please refer to FIG. 6 and FIG. 8. FIG. 8 is a transversely perspective cross-sectional diagram according to the second exemplary embodiment of the present invention. The clutch units 511, 521 on the ends of the elastic arms 51, 52 are semicircular protuberant structures. The clutch units 511, 521 can close up so as to go through the holes 74, 75. After the clutch units 511, 521 fully pass through the holes 74, 75, the clutch units 511, 521 depart from each other and respectively clutch the edge of the holes 75 to fix the ear-hook 50 in the ear-hook pin-jointed part 73.

Please note that the clutch units 511, 521 can be protuberant structures in other shapes or inverted hook structures only if the clutch units can clutch the edges of the holes 74 or 75 after the elastic arms 51, 52 going through the holes 74, 75 to ensure fixing the ear-hook 50 in the ear-hook pin-jointed part 73.

Optionally, the rotatable loop 70 can be a circular ring, a ring of other shape, or a partially circular ring whose radian is equal to or greater than 180 degrees only if a pair of tenons 71, 72 on the rotatable loop 70 can be positioned at opposite ends of the rotatable loop 70 to contact with the body 60.

Furthermore, the upper and lower housings of the body of the earphone provided by the present invention are not limited to be in the shape of a circular plate, and can be in a variety of shapes; for example: star, polygon, heart, petal, butterfly, on condition that the shape of the upper and lower housings match that of the rotatable loop and does not prevent their opposite rotation with each other through 360 degrees.

A stereo earphone apparatus can comprise the earphone of the present invention. For example, the stereo earphone apparatus is a Bluetooth stereo earphone apparatus. One earphone of the stereo earphone apparatus has Bluetooth capability, which can be used as a hands-free receiver, and the other earphone of the stereo earphone apparatus does not have Bluetooth capability. Wherein, the earphone with Bluetooth capability is the earphone of the present invention. The position of the ear-hook of the earphone with Bluetooth capability can be adjusted depending on the user's preference in order to match the user's right or left ear when being used as a hands-free receiver.

The ear-hook position of the earphone with Bluetooth capability can be adjusted to the right/left ear according to the other earphone without Bluetooth capability (for use on the left/right ear) for allowing the stereo earphone apparatus to be worn on the left and right ears. In another embodiment of the present invention, the pair of earphones in the stereo earphone apparatus both can be the earphones of the present invention, so that there is no need to distinct which ear phone is for left or right ear since the earphone in the stereo earphone apparatus can be worn on the left or right ear by simply adjusting its ear-hook position to fit user's preference. Please note that any alternative designs according to the spirit of the present invention also fall within the scope of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An earphone, comprising:

a body, having a surrounding side;

a rotatable loop, pivotally connected with the body on two opposite ends of the surrounding side, wherein the body and the rotatable loop rotate with respect to a first axis and with respect to each other; and an ear hook, pivotally mounted on one side of the rotatable loop near where the rotatable loop is connected with the body, used to rotate with respect to a second axis, wherein the second axis is different from the first axis, and is on a plane that the rotatable loop is positioned on, the first axis and the second axis are on the plane, intersected, and perpendicular to each other, and the body rotates toward and outward the plane, such that the earphone is adjusted to be worn on a right or left ear.

2. The earphone of claim 1, wherein the rotatable loop is a ring or a half ring whose shape matches a shape of the body.

3. The earphone of claim 1, wherein a pair of pivot holes are oppositely disposed inside of the rotatable loop, the body comprises an upper housing and a lower housing, the upper housing and the lower housing form the surrounding side, a pair of short tenons respectively extend from the upper housing and the lower housing and are respectively fixed in the pivot holes, wherein an ear-hook pin-jointed part is extended from outside of one side of the rotatable loop near one of the pair of pivot holes, and an end of the ear hook is fixed in the ear-hook pin-jointed part.

4. The earphone of claim 3, wherein the ear-hook pin-jointed part comprises at least a hole, the end of the ear hook is through the hole for fixing the ear hook in the ear-hook pin-jointed part, and the ear hook is capable of rotating with respect to a central axis of the hole.

5. The earphone of claim 4, wherein the end of the ear hook fixed in the ear-hook pin-jointed part comprises a pivot part, a fixed part and a cap, the cap covers the fixed part, and a diameter on top of the cap is greater than an inner diameter of the hole.

6. The earphone of claim 1, wherein a pair of tenons are oppositely extended from inside of the rotatable loop, each of the tenons has a tenon part and a top part extended from the tenon part, the body comprises an upper housing and a lower housing, the upper housing and the lower housing form the surrounding side, concave gaps are oppositely disposed on the upper housing and the lower housing, the concave gaps form fixed holes for the pair of tenons, diameters on the top parts of the tenons are greater than inner diameters of the concave gaps, an ear-hook pin-jointed part is extended from outside of one side of the rotatable loop near one of the pair of tenons, and an end of the ear hook is fixed in the ear-hook pin-jointed part.

7. The earphone of claim 6, wherein the ear-hook pin-jointed part comprises at least a hole, the end of the ear hook is through the hole for fixing the ear hook in the ear-hook pin-jointed part, and the ear hook is capable of rotating with respect to a central axis of the hole.

8. The earphone of claim 7, wherein the end of the ear hook fixed in the ear-hook pin-jointed part comprises a pivot part, a fixed part and a cap, the cap covers the fixed part, and a diameter on top of the cap is greater than an inner diameter of the hole.

9. The earphone of claim 1, wherein the end of the ear hook fixed in the ear-hook pin-jointed part comprises a pair of elastic arms, clutch units are respectively formed at ends of the pair of elastic arms, the ends of the pair of elastic arms are closed up under a certain amount of pressure and are capable of going through the hole to insert the ear-hook pin-jointed part, the ends of the pair of elastic arms return to normal when the pressure is not in effect and the clutch units clutch an edge of the hole to fix the ear hook in the ear-hook pin-jointed part.

10. A stereo earphone apparatus, comprising:

a first earphone; and a second earphone;

wherein at least one of the first and second phone is the earphone of claim 1.

* * * * *